US009366081B2

(12) United States Patent
Howie

(10) Patent No.: US 9,366,081 B2
(45) Date of Patent: Jun. 14, 2016

(54) ADJUSTABLE WINDOW COVERING SYSTEM

(71) Applicant: Nina Howie, Los Angeles, CA (US)

(72) Inventor: Nina Howie, Los Angeles, CA (US)

( * ) Notice: Subject to any disclaimer, the term of this patent is extended or adjusted under 35 U.S.C. 154(b) by 142 days.

(21) Appl. No.: 14/019,711

(22) Filed: Sep. 6, 2013

(65) Prior Publication Data

US 2015/0068690 A1 Mar. 12, 2015

(51) Int. Cl.

| | |
|---|---|
| ***E06B 9/24*** | (2006.01) |
| ***E06B 9/42*** | (2006.01) |
| ***E06B 7/28*** | (2006.01) |
| *E06B 9/40* | (2006.01) |

(52) U.S. Cl.

CPC ... *E06B 9/42* (2013.01); *E06B 7/28* (2013.01); *E06B 9/24* (2013.01); *E06B 2009/2441* (2013.01); *E06B 2009/2494* (2013.01); *E06B 2009/402* (2013.01); *E06B 2009/405* (2013.01); *E06B 2009/407* (2013.01)

(58) Field of Classification Search

USPC ..... 160/368.1, 354, 327, 349.2, 84.04, 160/84.01, 330, 123, 124, 125

IPC ..... E06B 2009/2441; A47H 1/022

See application file for complete search history.

(56) References Cited

U.S. PATENT DOCUMENTS

| | | | | | |
|---|---|---|---|---|---|
| 1,606,632 | A | * | 11/1926 | Harris | 160/125 |
| 1,868,439 | A | * | 7/1932 | Zielinski | 211/105.6 |
| 2,094,299 | A | * | 9/1937 | McQuarrie | 160/85 |
| 2,305,468 | A | * | 12/1942 | Ferrigno | 160/354 |
| 4,880,045 | A | * | 11/1989 | Stahler | 160/84.04 |
| 4,986,329 | A | * | 1/1991 | Kupchunos | 160/84.01 |
| 5,010,944 | A | * | 4/1991 | Bussert | 160/354 |
| 5,025,848 | A | * | 6/1991 | Prochaska | 160/368.1 |
| 5,111,866 | A | * | 5/1992 | Prostko | 160/90 |
| 6,296,041 | B1 | * | 10/2001 | Cicero | 160/327 |
| 2008/0245486 | A1 | * | 10/2008 | Brown | 160/84.01 |

* cited by examiner

*Primary Examiner* — David Purol

(74) *Attorney, Agent, or Firm* — Morrison & Forester LLP

(57) ABSTRACT

An adjustable window covering system for substantially or partially covering a window to block light, provide privacy, reduce heating/air conditioning costs, reduce installation costs, or change the aesthetic appeal of the window or the area around the window is disclosed. A user can dynamically adjust the configuration, location, position, and material layer of the adjustable window covering system without the use of tools and without damage done to the walls of a window.

20 Claims, 19 Drawing Sheets

ADJUSTABLE WINDOW COVERING SYSTEM

FIELD OF THE DISCLOSURE

This disclosure generally relates to a dynamically adjustable window covering system and methods of using and installing the same.

BACKGROUND OF THE DISCLOSURE

Windows can be covered by an adjustable window covering system to block light, provide privacy, reduce heating/air conditioning costs, reduce installation costs, or change the aesthetic appeal of the window or the area around the window, among other things. An adjustable window covering system can be installed to substantially or partially cover the window. The user can dynamically adjust the configuration of the adjustable window covering system by varying the amount and location of coverage without installing a different window covering system. However, in conventional adjustable window covering systems, it can be difficult for a user to dynamically adjust the configuration of the window covering. In addition, the number of configurations and the types and amounts of adjustments are also limited.

SUMMARY OF THE DISCLOSURE

Examples of the disclosure are directed to a dynamically adjustable window covering system that can be installed without the use of tools and without damage done to the walls of a window. The user can dynamically change the location, position, configuration, and material layer of the adjustable window covering system.

DETAILED DESCRIPTION

In the following description of examples, reference is made to the accompanying drawings which form a part hereof, and in which it is shown by way of illustration specific examples in which the disclosure can be practiced. It is to be understood that other examples can be used and structural changes can be made without departing from the scope of the disclosed examples.

This relates to an adjustable window covering system to block light or provide privacy, for example, by preventing a user on one side of the system from viewing at least a portion the other side of the system. In other examples, the adjustable window covering system may have a purely aesthetic function. The improved design of the adjustable window covering system and the ability to dynamically adjust the position, location, and configuration of the adjustable window covering system can lead to ease in installation, lower cost, increased flexibility, enhanced aesthetic appeal, better portability, and multi-functionality, among other things. Furthermore, although examples of the disclosure are provided in the context of a window opening, it should be understood that this disclosure is not so limited, but is generally applicable to coverings for other types of openings, such as doorways, vents, bathtub or shower enclosures, wall cutouts or niches, open bookcases or cabinets, and any other opening for which a adjustable covering is desired.

Some examples of the disclosure are directed to an adjustable window covering system which can cover or block light from penetrating through one end of a window, such as the bottom, while allowing light to penetrate through another end of the window, such as the top. In some examples, the adjustable window covering system can block light from penetrating from the top, while allowing light to penetrate from the bottom. In some examples, the adjustable window covering system can cover or block both ends of the window. In some examples, the adjustable window covering system can allow light to penetrate through both ends. The adjustable window covering system can secure to the window without any structural damage or alterations to the window, leading to ease in installation and lower cost. The user can dynamically change the configuration of the adjustable window covering system by varying the amount and location of coverage of the window, leading to increased flexibility and enhanced aesthetical appeal. One or more material layers of the adjustable window covering system can be replaced or laundered to suit the user's desires and for increased sanitation. Additionally, the adjustable window covering system can be easily moved to cover a different window, leading to increased portability, or can be used for different multi-functional purposes.

Figure 1:
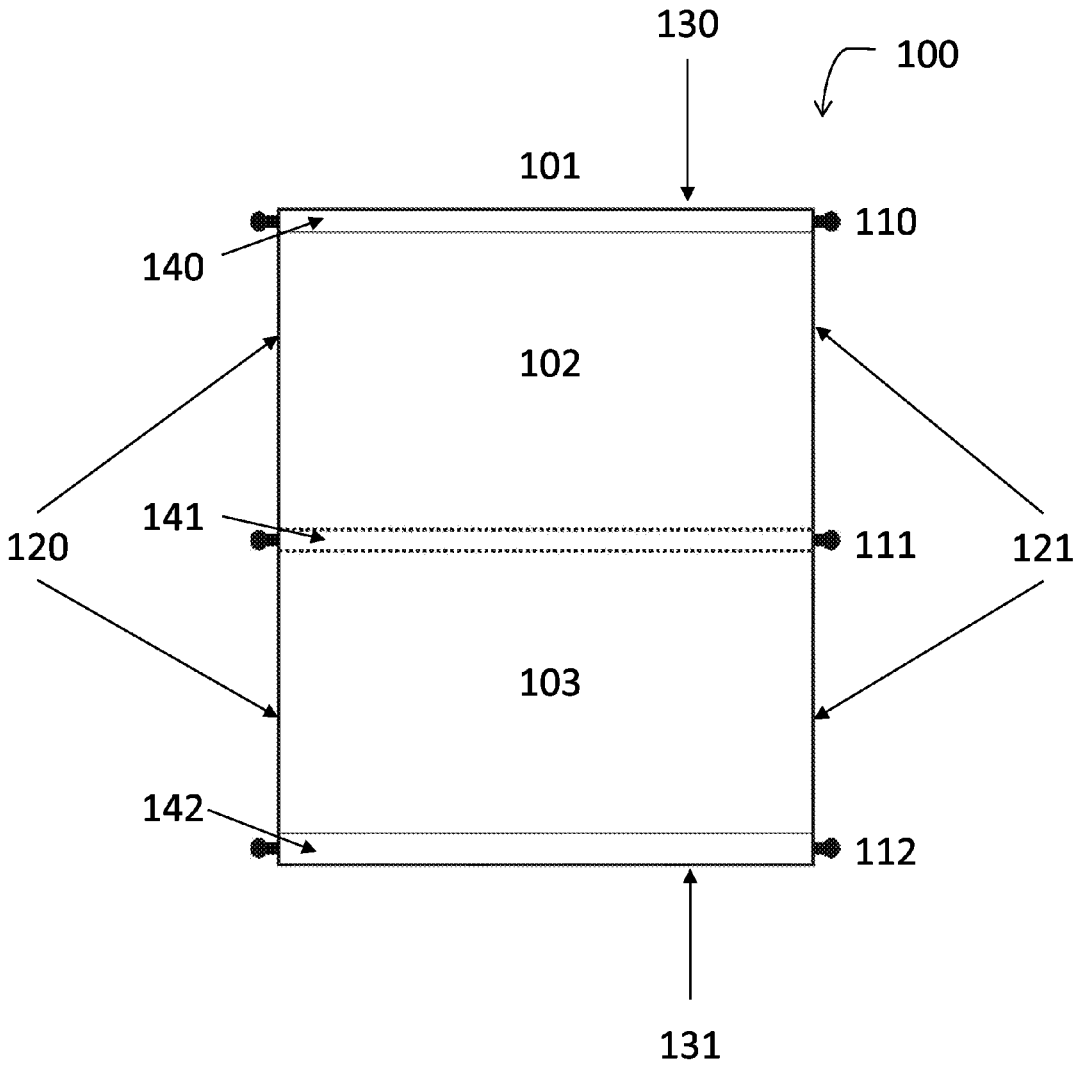
FIG. 1 illustrates a front view of an exemplary adjustable window covering system.

FIG. 1 illustrates a front view of an exemplary adjustable window covering system. The adjustable window covering system 100 can comprise a material layer 101 and a plurality of rods 110, 111, 112. The material layer can comprise an upper panel 102, a lower panel 103, a plurality of vertical edges 120 and 121, and a plurality of horizontal edges or distal ends 130 and 131. The material layer can comprise a plurality of openings: an upper opening 140, a middle opening 141, and a lower opening 142. While FIG. 1 shows three openings, the material layer can include any number of openings and is not limited to the upper, middle, and lower openings. In some examples, the material layer can have no openings, with the rods secured to the material layer without the use of openings. Additionally, the adjustable window covering system can include any number of rods and is not limited to an upper, middle, and lower rod. The upper opening can be coupled to the upper rod, middle opening can be coupled to the middle rod, and lower opening can be coupled to the lower rod.

Figure 2:
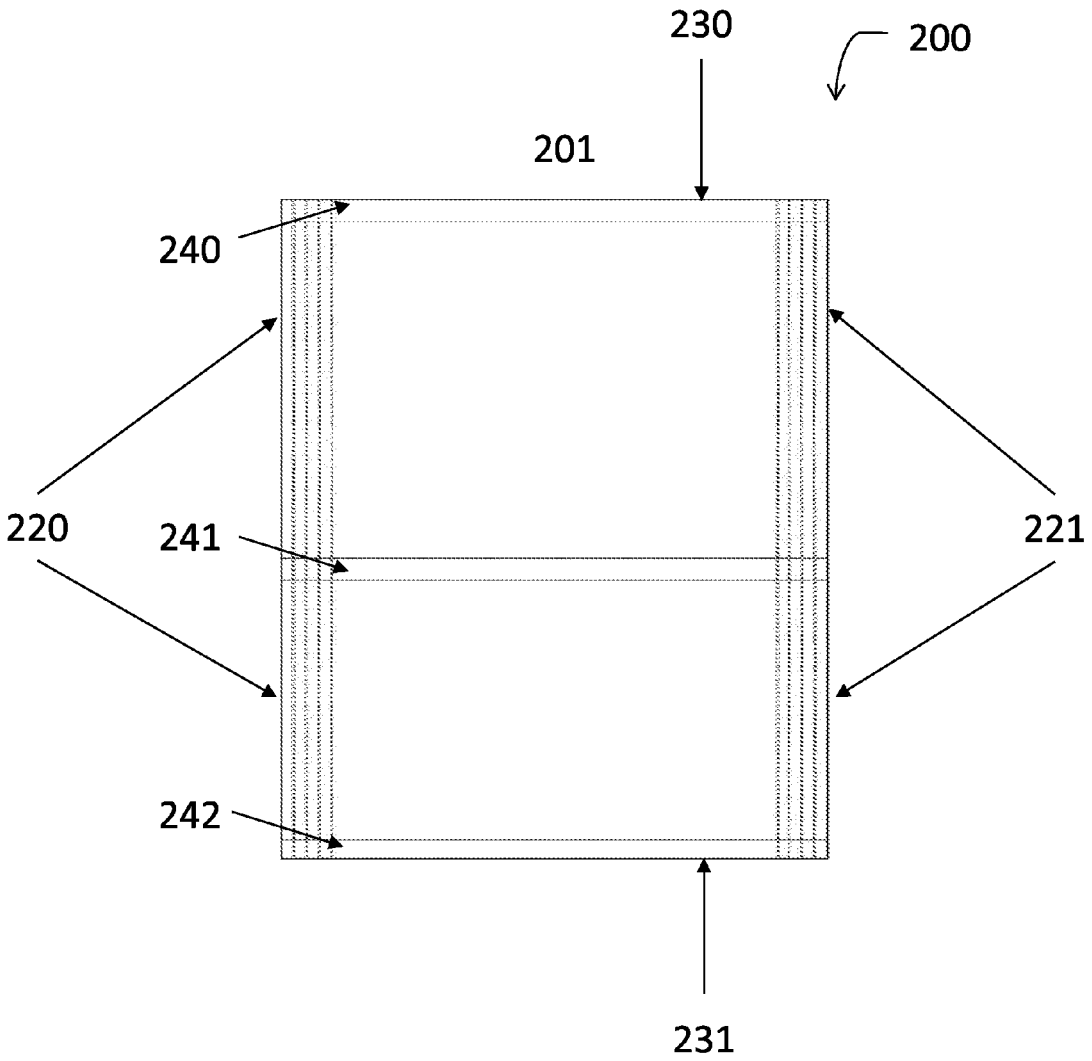
FIG. 2 illustrates a back view of an exemplary adjustable window covering system.

FIG. 2 illustrates a back view of an exemplary adjustable window covering system 200. Material layer 201 can be made of a material capable of blocking light, providing privacy, or providing an aesthetic appeal to the user. The material layer can be drapeable, flexible, or rigid. In some examples, the material layer can be made from a single piece of material or can comprise a plurality of separate pieces of one or more materials. The plurality of openings 240, 241, 242 can be any type of opening where one or more rods can be inserted such as pockets, grommets, hooks, and loops. At connection points, the material layer can hang or rest against the rods. One or more of the openings can, for example, comprise openings at the horizontal edges or distal ends 230 and 231. The openings can be fully or partially enclosed. The openings can be formed using a number of different techniques including, but not limited to, sewing, gluing, fastening, or tying.

In some examples, the size and dimensions of the material layer can be adjusted by removing portions of the material layer at the location of the vertical edges 220 and 221, horizontal edges 230 and 231, or both using a cutting device, such as a scissors or knife. While FIG. 2 exemplifies removing portions of the material layer with the user viewing the back of the adjustable window covering system, portions of the material layer can be also removed with the user viewing the front or from both front and back. Additionally, while FIG. 2 shows a rectangular material layer, the material layer can comprise any shape, such as circular, oval, or trapezoidal.

Figure 3:
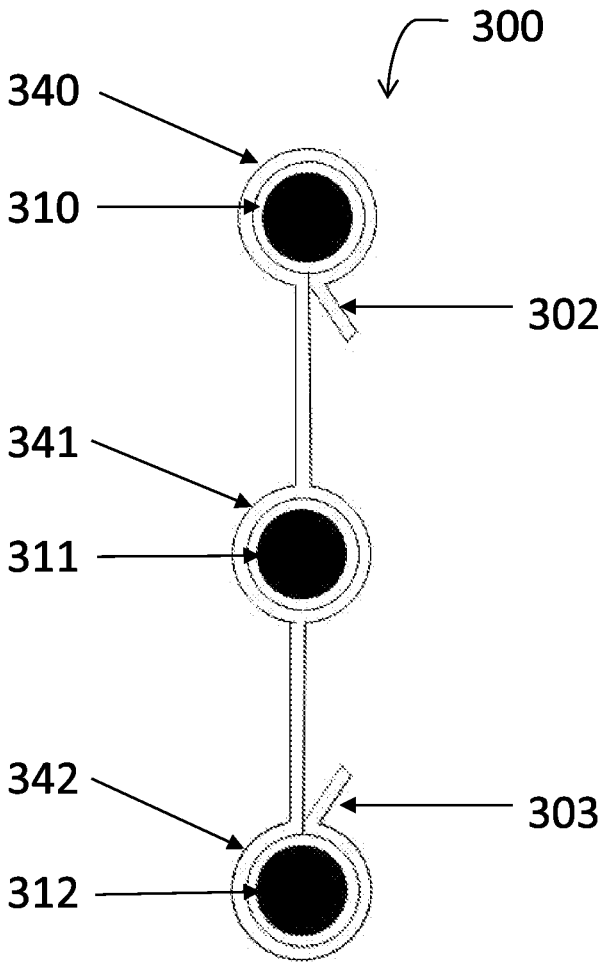
FIG. 3 illustrates a side view of an exemplary adjustable window covering system.

FIG. 3 illustrates a side view of an exemplary adjustable window covering system 300. The upper rod 310, middle rod 311, and lower rod 312 can be inserted into the openings 340, 341, and 342, and the material layer can drape from the rods. To form the upper opening 340 and lower opening 342 as pockets, the material layer can be folded over by the user and secured to itself using any number of securing means, such as adhesive or fasteners, at upper securing location 302 and lower securing location 303. In some examples, the middle opening 341 can be formed prior to portions of the material layer being removed. In some examples, the middle opening 341 can be formed by the user at the same time the upper opening and lower opening are formed.

Figure 4:
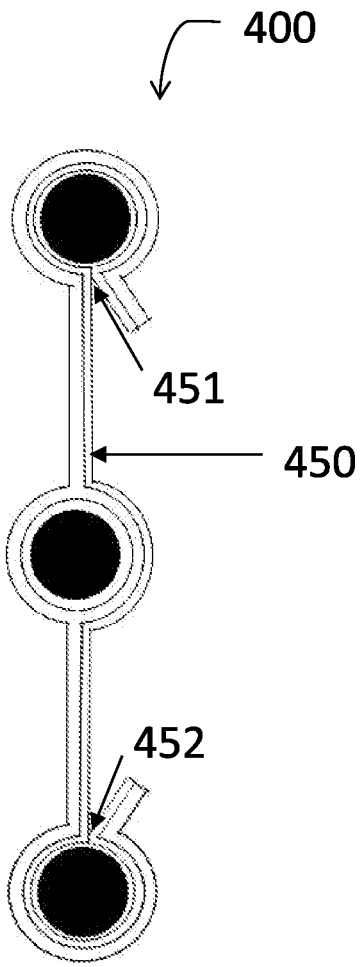
FIG. 4 illustrates a side view of an exemplary adjustable window covering system with an adhesive layer.

FIG. 4 illustrates a side view of an exemplary adjustable window covering system 400 with an adhesive layer 450 disposed on the back of the material layer for the formation of pockets as the plurality of openings. The adhesive layer can be a dry film adhesive, and can cover a substantial area of the back of the material layer. In some examples, the adhesive layer can be smaller than the back of the material layer and can cover one or more areas of the back of the material layer at one or more locations. The user can fold the material layer over such that at least an area of the adhesive contacts with another area of the adhesive at locations 451 and 452. A process to activate the adhesive, such as heat, can be applied to secure the adhesive together. In some examples, the adhesive layer can prevent fraying of the material layer at the location of the horizontal edges or vertical edges when, for example, the user removes portions of the material layer.

Figure 5:
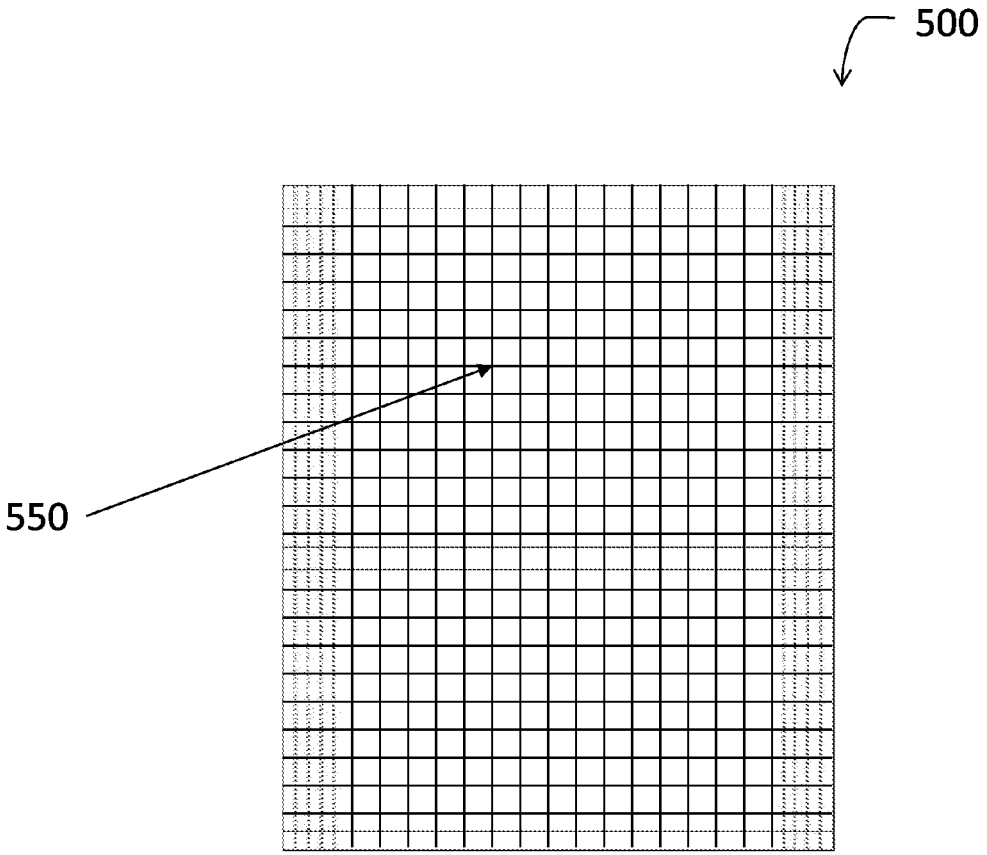
FIG. 5 illustrates a back view of an exemplary adjustable window covering system with a backing layer.

FIG. 5 illustrates a back view of an exemplary adjustable window covering system 500 with a backing layer. The backing layer can be adhered to the adhesive layer prior to formation of the openings and can comprise a pattern 550 such as vertical lines, horizontal lines, or a grid. The pattern can be used by the user as a guide for adjusting the size and dimensions of the material layer. Additionally, any number of other layers can be disposed on the back of the adjustable window covering system including, but not limited to, a thermal liner or a reflective layer. In some examples, the backing layer can be detachable from the adhesive layer. In some examples, the backing layer can rest against the adhesive layer and is adhered to the adhesive layer.

Figure 6A:
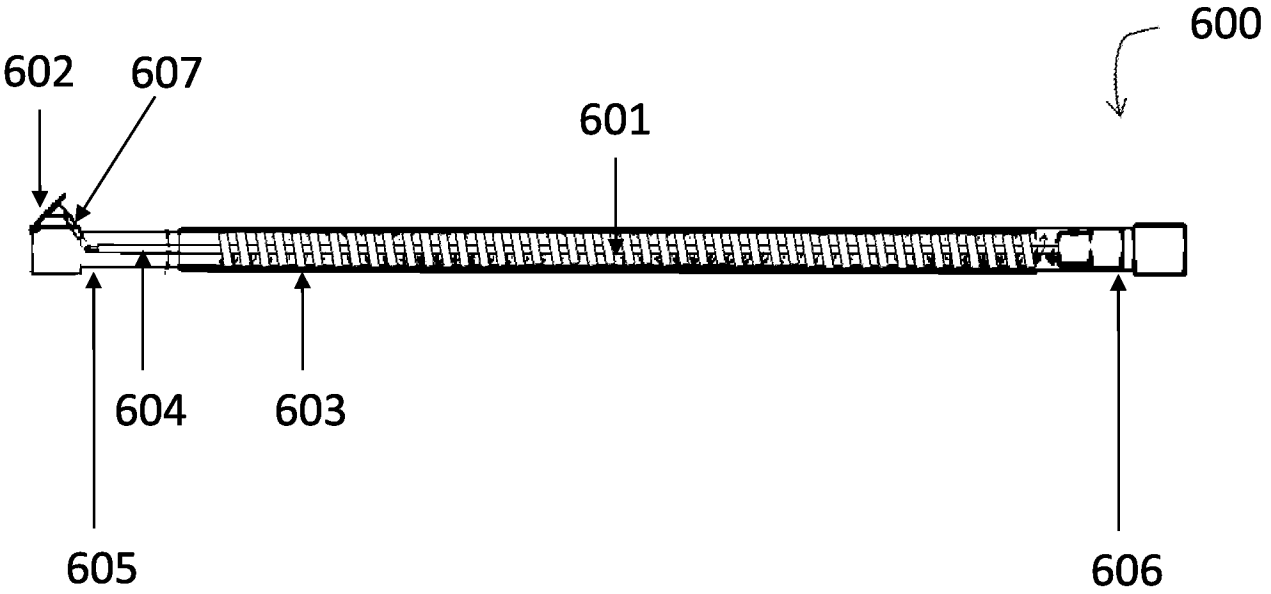
FIG. 6A illustrates an exemplary rod.
Figure 6D:
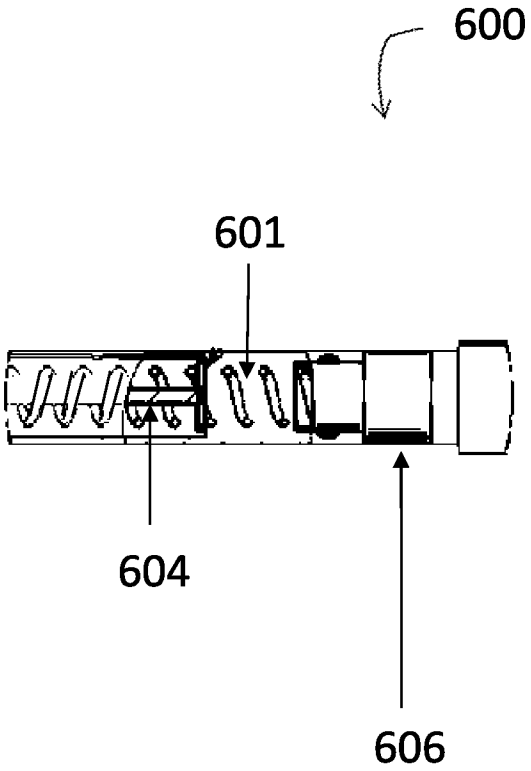
FIG. 6D illustrates the second end of the exemplary rod in an active state during the installation of the adjustable window covering system.
Figure 6C:
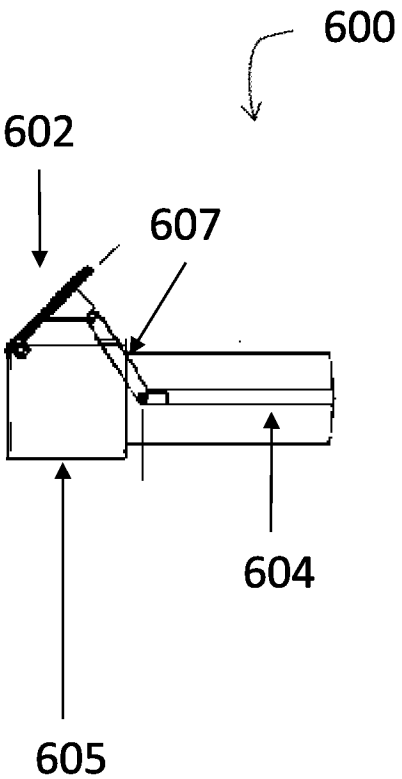
FIG. 6C illustrates the first end of the exemplary rod in an active state during the installation of the adjustable window covering system.
Figure 6B:
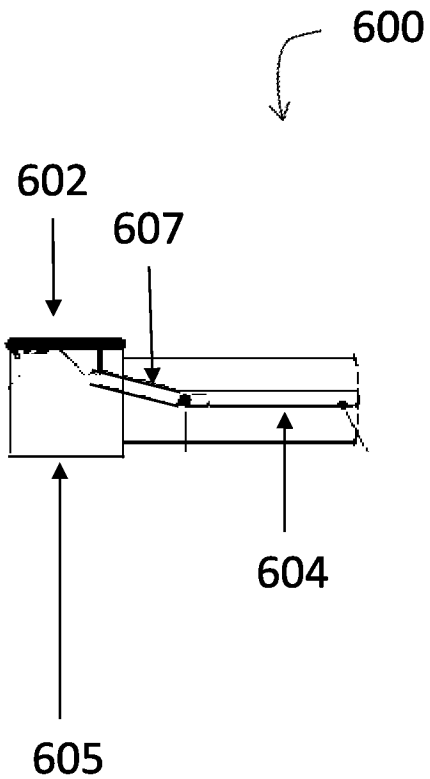
FIG. 6B illustrates a first end of the exemplary rod in a mounted state or when the rod is secured to the window.

FIG. 6A illustrates an exemplary rod 600. The rod can comprise a spring 601, a lever 602, a link 607, a pole 604, a fixed first end 605, a movable second end 606, and a housing member 603, wherein the second end is movable with respect to the housing member along the longitudinal axis of the rod. The first and second end can be coupled to one or more footpads (not shown). The pole can be coupled to the movable second end, and the movable second end can be coupled to the spring. The spring can be fixed at the first end. The lever can be pivotably coupled to the first end and the link, and the link can be pivotably coupled to the pole. FIG. 6B illustrates a first end of the exemplary rod in a mounted state or when the rod is secured to the window. In the mounted state, the lever can be rotated to be aligned alongside the first end 605, which can then force the link to push the pole along its longitudinal axis. This can allow the spring to extend or at least apply a force on the second end while the adjustable window covering system is mounted. In turn, the second end can apply a force to a surface such as the side jamb of a window when the second end 606 comes into contact with the side jamb. During installation or repositioning, the lever can be lifted by the user. FIG. 6C illustrates the first end of the exemplary rod in an active (unmounted, movable) state, and FIG. 6D illustrates the second end of the exemplary rod. As the lever is lifted, the pole and link can pull the second end closer to the first end and apply pressure against the spring, causing the spring to compress. Pulling of the second end closer to the first end and compression of the spring can cause retraction of the second end of the pole, temporarily reducing the length of the rod (or at least releasing the force being applied by the second end) to allow for removal and/or insertion of the rod within the window. When the lever is released, the spring can resume its normal position, thereby extending the length of the rod or at least transferring the force of the spring to any surface that the one or more footpads contact. By transferring the force of the spring and contacting the footpads and ends of the rod with the walls or jambs of the window, the rod can be installed without the use of tools and can also be dynamically removed or adjusted.

Figure 7A:
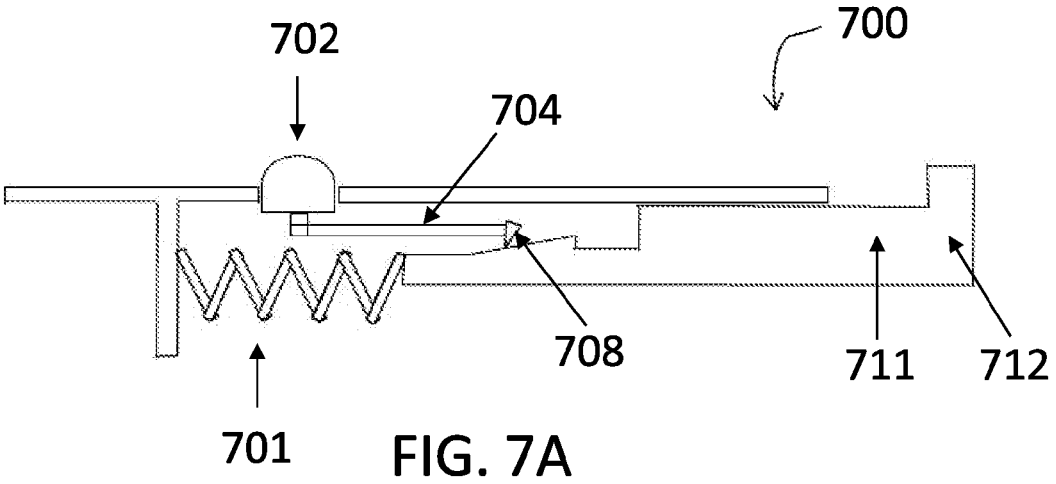
FIG. 7A illustrates an end of an exemplary rod in a mounted state or when the rod is secured to the window.
Figure 7B:
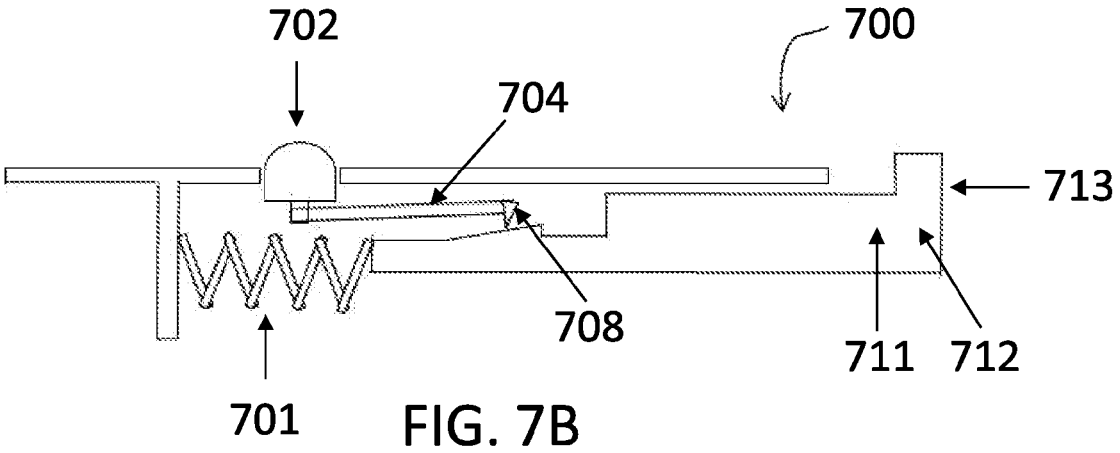
FIG. 7B illustrates an end of an exemplary rod in an active state during the installation of the adjustable window covering system.
Figure 7C:
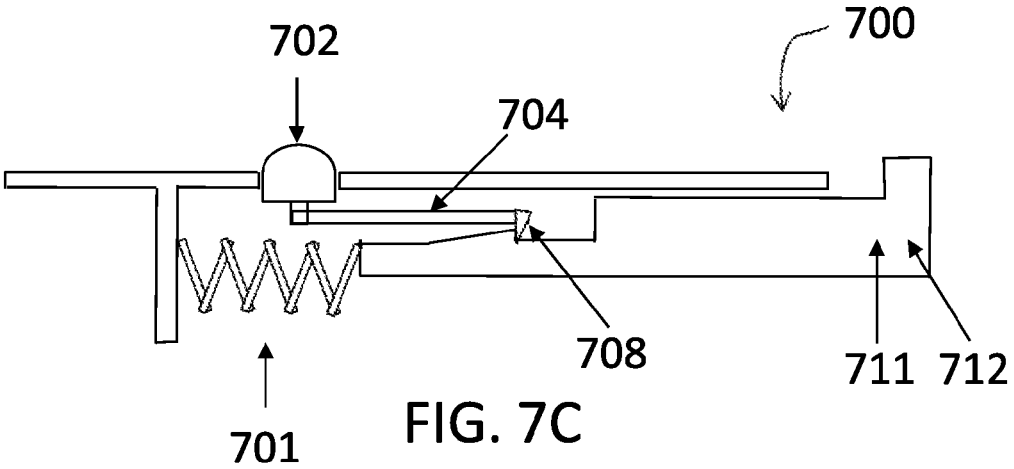
FIG. 7C illustrates an end of an exemplary rod in an active state during installation of the adjustable window covering system.

FIGS. 7A-7C illustrate an exemplary rod 700 and a close-up view of an alternative retraction mechanism in an end of the rod. The end can comprise a spring 701, a button 702, a pole 704, a hook 708, and a post 711. The post can be formed in the shape of a ramp. In a mounted state, as shown in FIG. 7A, the spring can apply a force to the post, thereby transferring the tension of the spring to the post at location 712. Location 712 can contact foot pads which can then contact the walls of the window. During installation, pressure can be applied by the user at location 712 in a direction opposite the spring tension, as shown by arrow 713 in FIG. 7B. This pressure can cause the hook to grab a notch in the ramp, forcing compression of the spring and also depression of the button, as shown in FIG. 7C. The applied pressure can shorten the length of the rod to be shorter than the window for installation. Once the rod is positioned, the user can then press the button which can release the hook from grabbing the notch in the ramp, and can also return the rod back to its mounted state.

Figure 8:
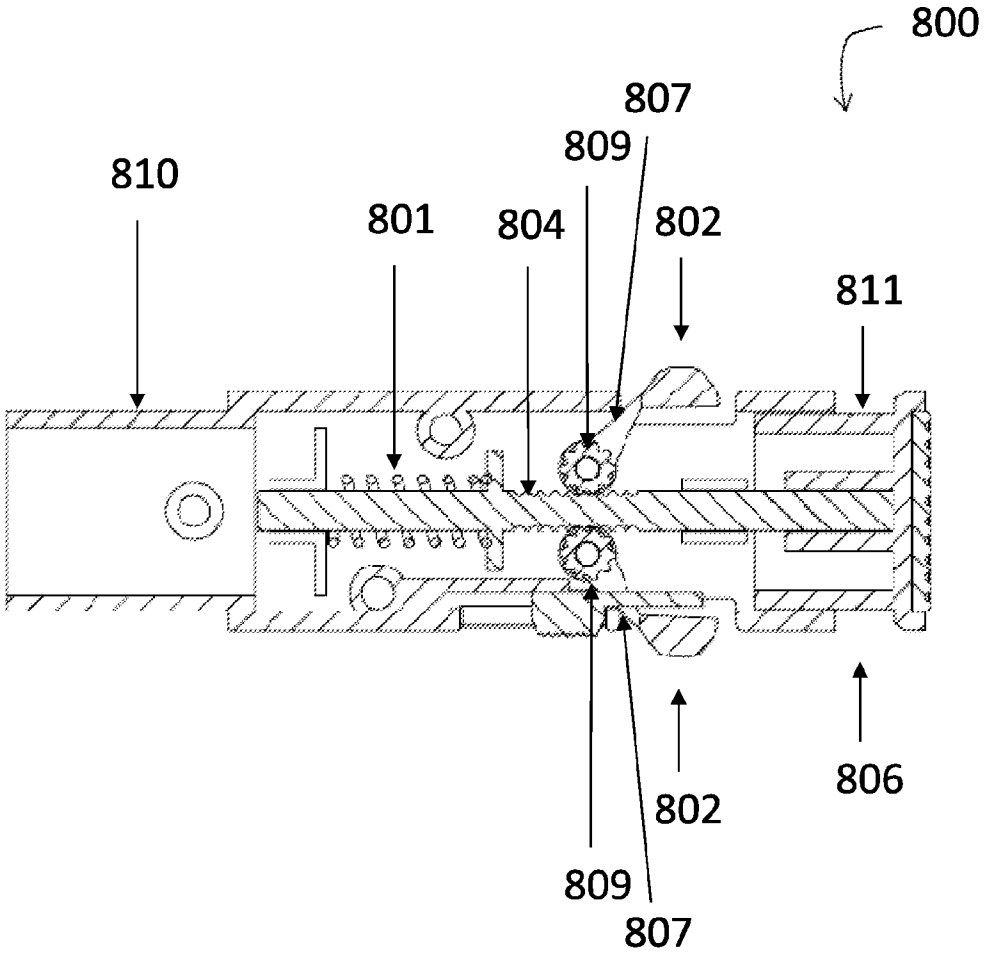
FIG. 8 illustrates an exemplary rod and a cross-sectional view of an end of the rod.

FIG. 8 illustrates an exemplary rod 800 and a cross-sectional view of an end of the rod 806. The end can comprise a spring 801, buttons 802, a pole 804, gears 809, links 807, and a post 811 encapsulated in housing 810. The buttons can be coupled to the gears through the links. Notched members can be located on at least a portion of the outside of the pole, and the gears can be coupled to the notched members. The notched members can be coupled to the spring. The spring can be coupled to the pole, and the pole coupled to the post. When the buttons are pressed down by the user, the gears can rotate in a direction away from the spring. The gears can grab the notched members, which can then pull the pole and post towards the gears causing the spring to compress. The action of pressing down the buttons retracts the post and pole to temporarily shorten the length of the rod. Releasing the buttons once the rod is positioned within the window can then return the gears, spring, post, and pole to their mounted state. Footpads can be disposed on the end of the rod for cushioning and/or gripping to the surface of a window jamb. In some examples, one gear can be used to grab notched members, and the gear can be rotated by pressing down on one button.

While the exemplary rods in FIGS. 6-8 comprise a single spring, examples can include a rod with one or more springs, one or more poles, and one or more housing members. Additionally, the buttons, springs, links, gears, posts, and notched members can be located in the center of the rod or in between the first and second end. In some examples, both ends of the rod can include buttons, springs, links, gears, and posts, and the tension of the springs can be transferred to both ends of the rod. In some examples, the levers and rods can be different shapes such as cylindrical or rectangular. In some examples, one or more ends of the rods can be shaped or sized taking into consideration the amount of transferred tension from the spring to the ends. The installation of the adjustable window covering system using one or more of the exemplary rods discussed earlier can prevent any damage done to the window that could otherwise happen with window covering systems that use securement means such as nails, screws, or adhesive.

Figure 9:
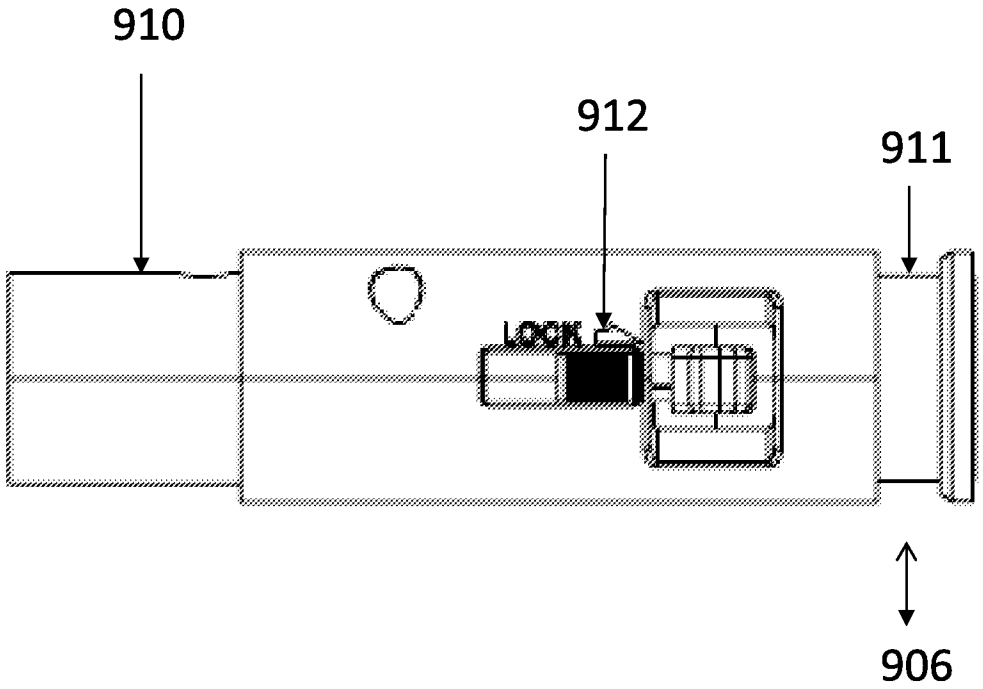
FIG. 9 illustrates an exemplary rod and close up view of an end of the rod including a locking mechanism.

FIG. 9 illustrates an exemplary rod and close up view of an end of the rod. The end can include a locking mechanism to lock the one or more buttons, springs, links, gears and posts in place after the rods have been installed and secured. In some examples, a locking mechanism can be configured to secure the lever 602 of FIG. 6A-6D. In some examples, the locking mechanism can be configured to secure the position of the button 702 of FIG. 7A-7C to prevent the pole 704 and hook 708 from moving its position along the ramp. In some examples, a locking mechanism can be configured secure the position of the gears 809 to prevent the gears from grabbing the notched members on the pole 804.

To install the adjustable window covering system, the plurality of rods can be inserted into one or more of the plurality of openings. Each of the plurality of rods can comprise a single piece or multiple pieces. Multiple pieces can allow for extension of the length of the rod. A rod can be cylindrical, rectangular, or the like with a foot attached to one or more ends of the rod. The plurality of rods can be any type of rod including, but not limited to, tension rods or extension rods. One of the plurality of rods can be positioned at a desired height and secured to the window by operating one or more levers or buttons, as was described earlier. Once the one plurality rod is secured, the remaining rods can be secured or left floating, unsecured.

Figure 10:
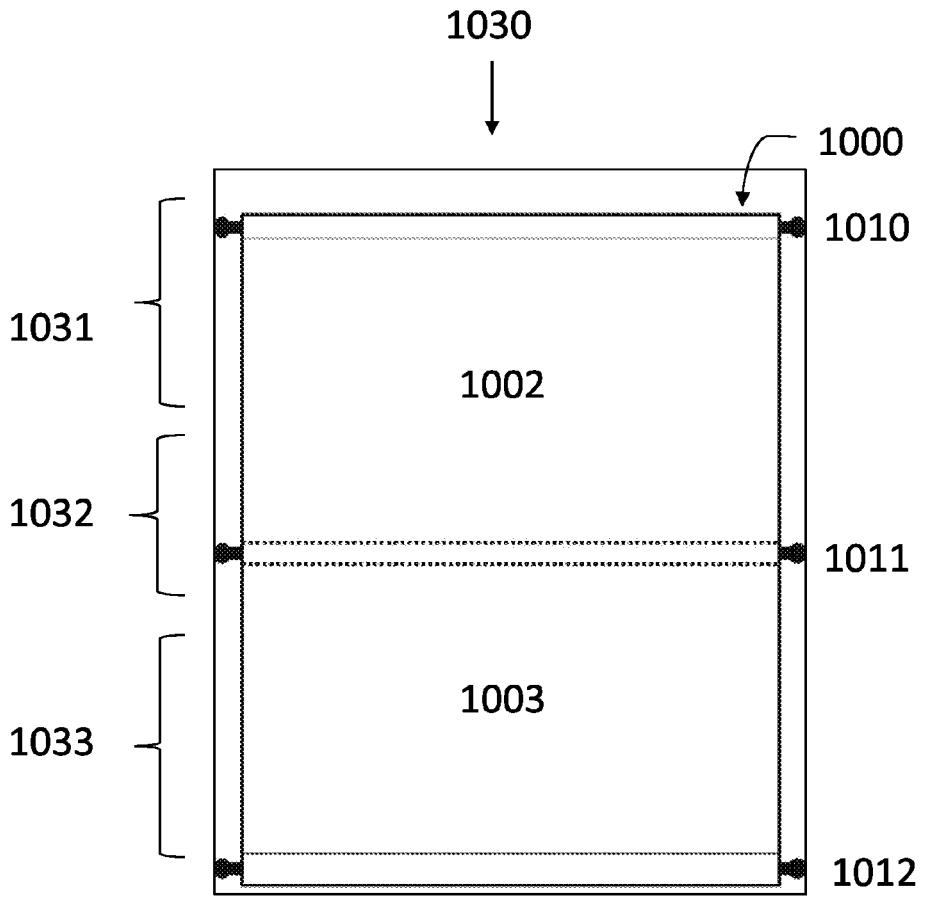
FIG. 10 illustrates an exemplary configuration of an adjustable window covering system configured to substantially cover a window.

The user can dynamically change the location of the plurality of rods. FIG. 10 illustrates an exemplary configuration of an adjustable window covering system 1000 configured to substantially cover window 1030. Adjustable window covering system can substantially cover the upper end 1031, middle end 1032, and lower end 1033 of the window providing substantial obstruction and blocking a substantial amount of light. Upper rod 1010 can be secured in a position in or near the upper end 1031. Middle rod 1011 can be secured in a position in or near the middle end 1032. Lower rod 1012 can be secured in a position in or near the lower end 1033. Both upper panel 1002 and lower panel 1003 of the material layer can be substantially viewable to the user.

Figure 11:
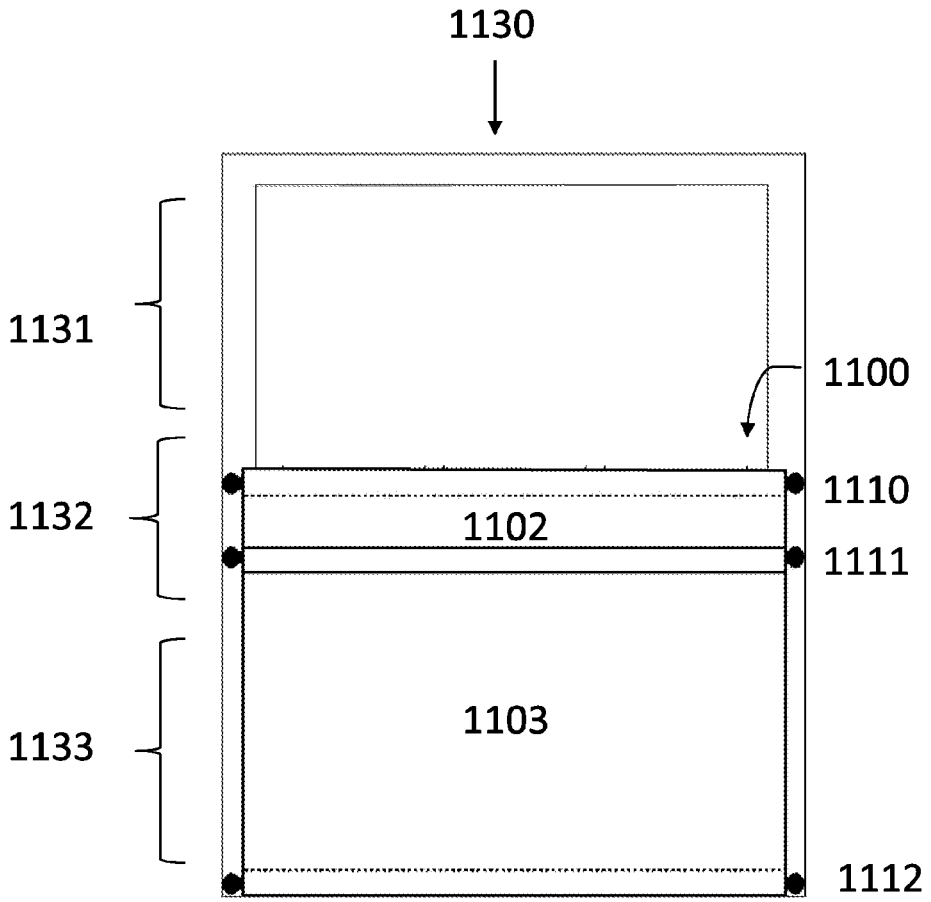
FIG. 11 illustrates an exemplary configuration of an adjustable window covering system configured to substantially cover a lower end of a window.

FIG. 11 illustrates an exemplary configuration of an adjustable window covering system 1100 configured to cover window 1130. Adjustable window covering system can substantially cover the lower end 1133 of the window, while allowing at least a partial obstruction or a portion of light to pass through the upper end of the window 1131. The lower rod 1112 can be secured in a position in or near the lower end 1133 of the window, while the upper rod 1110 and middle rod can be secured in a position in or near the middle end 1132 of the window. Lower panel 1103 of the material layer can be substantially viewable to the user and can overlap at least a portion of upper panel 1102 of the material layer. In some examples, the upper panel of the material layer can be substantially viewable to the user and can overlap at least a portion of the lower panel. In some examples, the upper and middle rod can be positioned such that upper panel of the material layer is not viewable to the user. In some examples, upper rod and lower rod can be secured in a position in or near the middle end of the window, while the middle rod can be secured in a position in or near the lower end of the window and the back of the lower panel of the material layer can be visible to the user.

Figure 12:
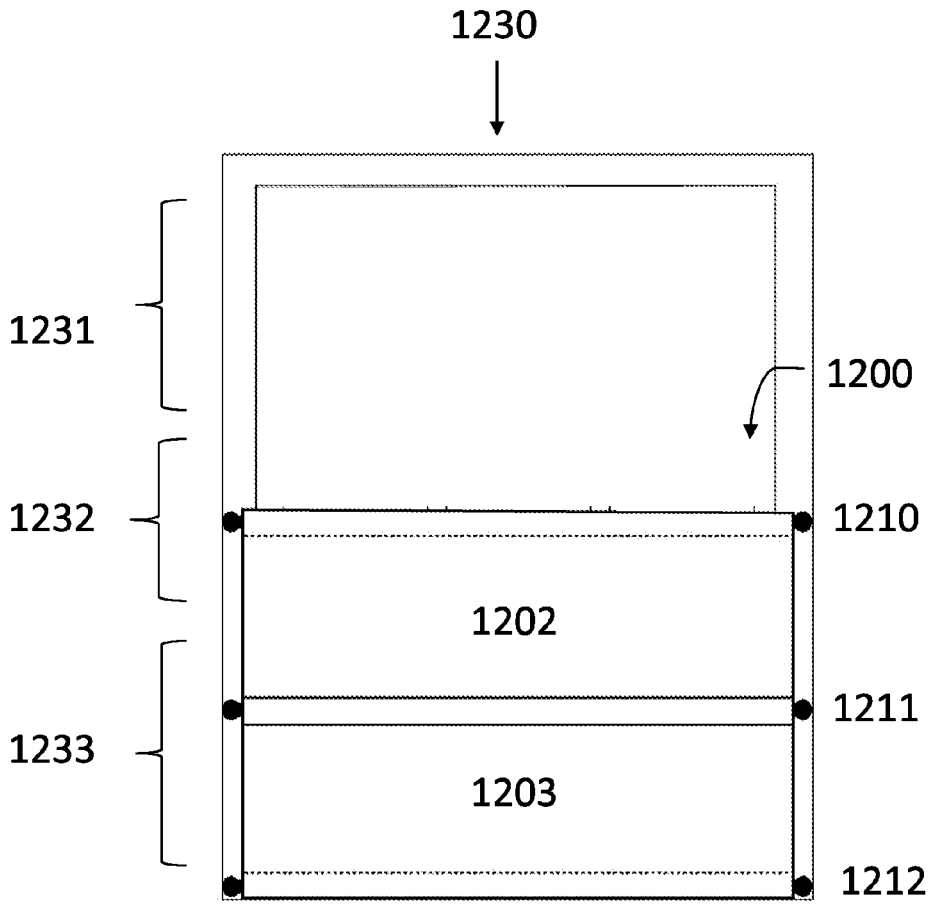
FIG. 12 illustrates an exemplary configuration of an adjustable window covering system configured to substantially cover a lower end of a window.

FIG. 12 illustrates an exemplary configuration of an adjustable window covering system 1200 configured to cover window 1230. Adjustable window covering system can substantially cover the lower end 1233 of the window while allowing at least a partial obstruction or a portion of light to pass through the upper end 1231 of the window. The upper rod 1210 can be secured in a position in or near the middle end 1232 of the window, while middle rod 1211 and lower rod 1212 can be secured in a position in or near the lower end 1233 of the window. In some examples, the middle rod can be positioned closer to the upper rod than the lower rod. In some examples, middle rod can be positioned closer to the lower rod than the upper rod. Both upper panel 1202 and lower panel 1203 of the material layer can be partially viewable to the user. In some examples, the lower rod can be secured in a position closer to the upper rod than the middle rod, and the back of the lower panel of the material layer can be visible to the user.

Figure 13:
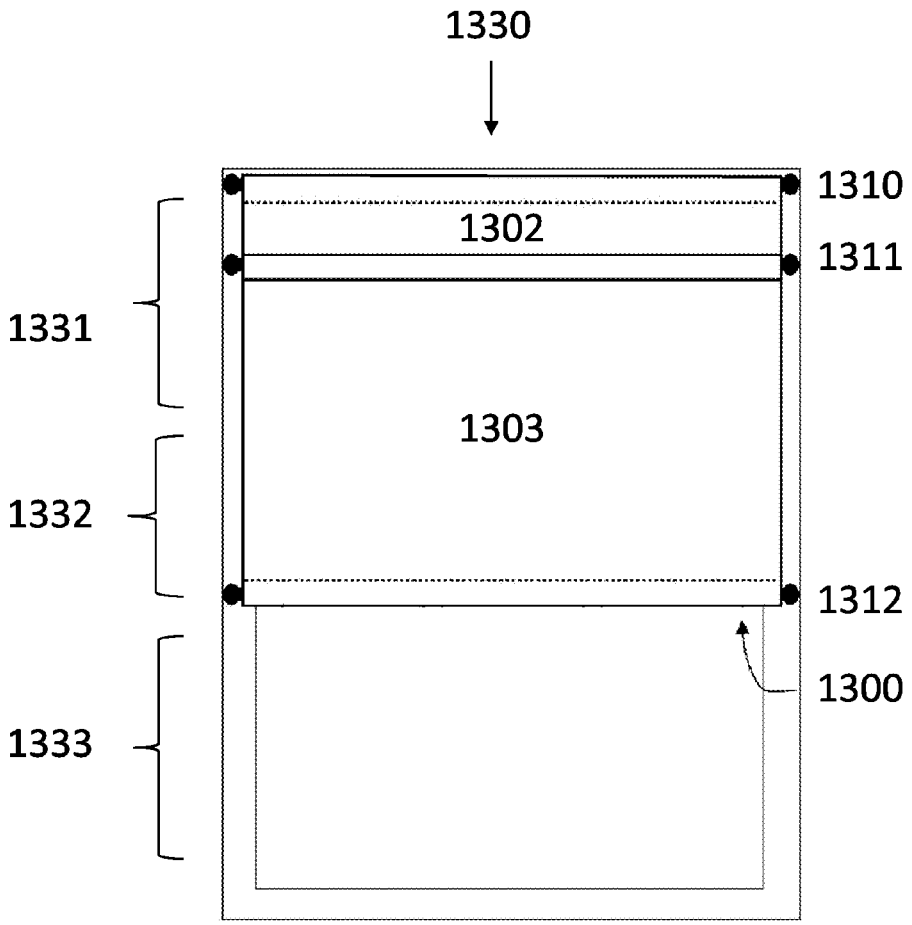
FIG. 13 illustrates an exemplary configuration of an adjustable window covering system configured to substantially cover an upper end of a window.

FIG. 13 illustrates an exemplary configuration of an adjustable window covering system 1300 configured to cover window 1330. Adjustable window covering system can substantially cover the upper end 1331 of the window while allowing at least a partial obstruction or a portion of light to pass through the lower end 1333 of the window. The upper rod 1310 and middle rod 1311 can be secured in a position in or near the upper panel 1331 of the window, while the lower rod 1312 can be secured in a position in or near the middle end 1332 of the window. Lower panel 1303 of the material layer can be substantially viewable to the user and can overlap at least a portion of the upper panel 1302 of the layer. In some examples, the upper panel of the layer can be substantially viewable to the user and can overlap at least a portion of the lower panel. In some examples, the upper and middle rod can be positioned such that the upper panel is not viewable to the user. In some examples, the upper rod and the lower rod can be secured in a position in or near the upper end of the window, while the middle rod lower can be secured in a position in or near the middle end of the window and the back of the lower panel of the material layer can be visible to the user.

Figure 14:
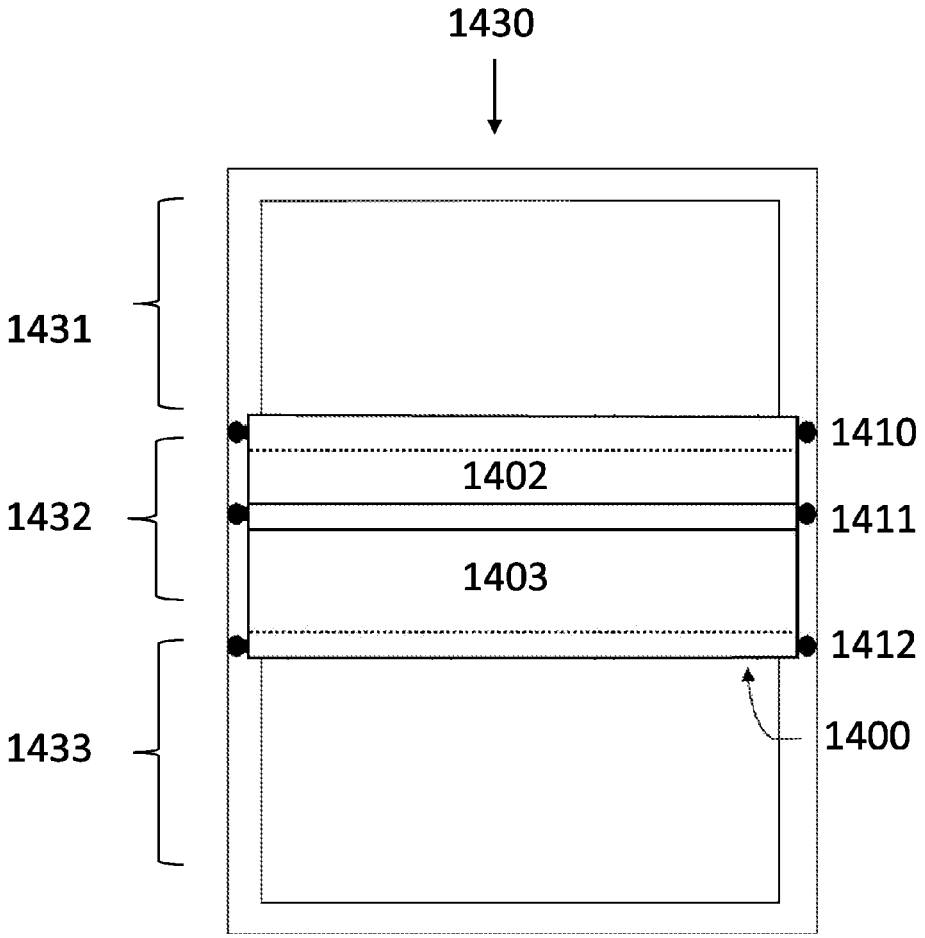
FIG. 14 illustrates an exemplary configuration of an adjustable window covering system configured to substantially cover a middle end of a window.

FIG. 14 illustrates an exemplary configuration of an adjustable window covering system 1400 configured to cover window 1430. Adjustable window covering system can substantially cover the middle end 1432 of the window while allowing at least a partial obstruction or a portion of light to pass through both the upper window 1431 and lower window 1433. The upper rod 1410, middle rod 1411, and lower rod 1412 can be secured in a position in or near the middle end of the window. The upper rod can be positioned closer to the upper end of the window than the middle rod and lower rod. The lower rod can be positioned closer to the lower end of the window than the middle rod and upper rod. Both upper panel 1402 and lower panel 1403 of the material layer can be partially viewable to the user. In some examples, at least a portion of the lower panel of the material layer can overlap at least a portion of the upper panel of the material layer. In some examples, the middle rod can be positioned closer to the lower end of the window than the upper and lower rod. In some examples, the middle rod can be positioned closer to the upper end of the window than the upper rod and lower rod.

By dynamically adjusting the position and location of the one or more rods, the amount of coverage of the adjustable window covering system can be varied. Additionally, the configuration of the adjustable window covering system can be changed such that the upper panel of the material layer overlaps the lower panel of the material layer or the lower panel of the material layer overlaps the upper panel. The configuration of the adjustable window covering system can be dynamically changed for enhanced aesthetical appeal. In some examples, the back of the lower panel can be visible to the user. In some examples, the orientation of one rod can differ from the orientation of another rod to create a twist in one of the panels of the material layer where both the front and back of the twisted panel are visible to the user.

Figure 15:
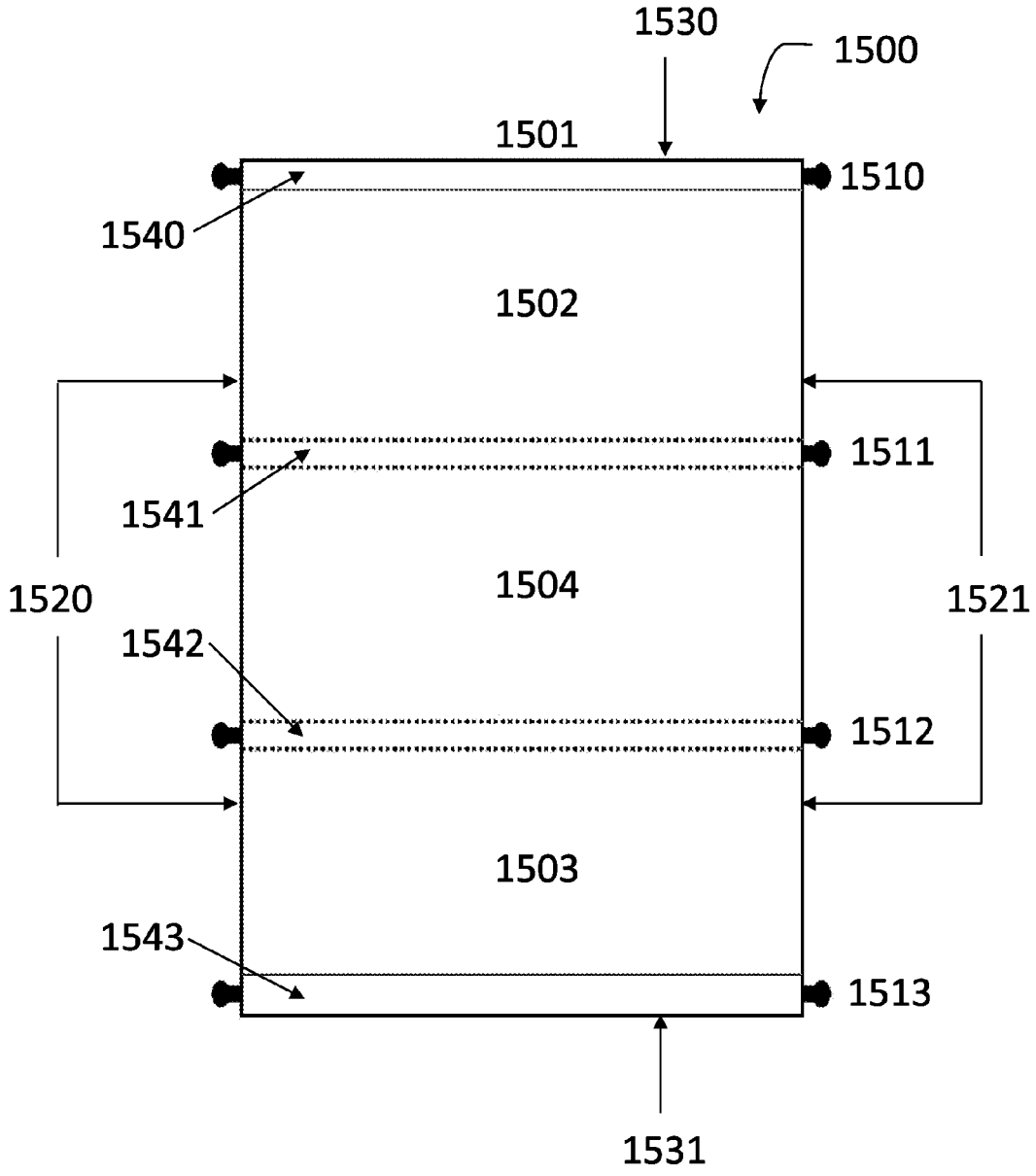
FIG. 15 illustrates an exemplary adjustable window covering system comprising a material layer with three panels.

FIG. 15 illustrates an exemplary adjustable window covering system comprising a material layer with three panels. The adjustable window covering system 1500 can comprise a material layer 1501 and a plurality of rods 1510, 1511, 1512, 1513. The material layer can further comprise an upper panel 1502, a middle panel 1504, a lower panel 1503, a plurality of vertical edges 1520 and 1521, and a plurality of horizontal edges or distal ends 1530 and 1531. The material layer can comprise a plurality of openings: a first opening 1540, a second opening 1541, a third opening 1542, and a fourth opening 1542. While FIG. 15 shows three panels of the material layer, four rods, and four openings, the adjustable window covering system can include a material layer with any number of panels and openings and any number of rods, and is not limited to two or three. The plurality of rods can include, but is not limited to, a first rod 1510, a second rod 1511, a third rod 1512, and a fourth rod 1512. The first opening can be coupled to the first rod, second opening can be coupled to the second rod, third opening can be coupled to the third rod, and fourth opening can be coupled to the fourth rod.

In some examples, the adjustable window covering system of FIG. 15 can be configured to substantially cover the window. In some examples, the adjustable window covering system can be configured to substantially cover the lower and middle end of the window while allowing at least a partial obstruction or a portion of light to pass through the upper end of the window. In some examples, the adjustable window covering system can be configured to substantially cover the upper and middle end of the window while allowing at least a partial obstruction or a portion of light to pass through the lower window. In some examples, the adjustable window covering system can be configured to allow a portion of light to pass through the middle end 1504 of the window, while substantially covering the upper end, lower end or both. In some examples, the adjustable window covering system can be configured to allow a portion of light to pass through the upper end, middle end, and lower end of the window. Allowing a portion of light to pass through the middle end of the window can be done by positioning the rods accordingly and using a material layer comprising a transparent or substantially transparent material. In some examples, any one of the upper, middle, or lower panels can include cutouts.

Figure 16:
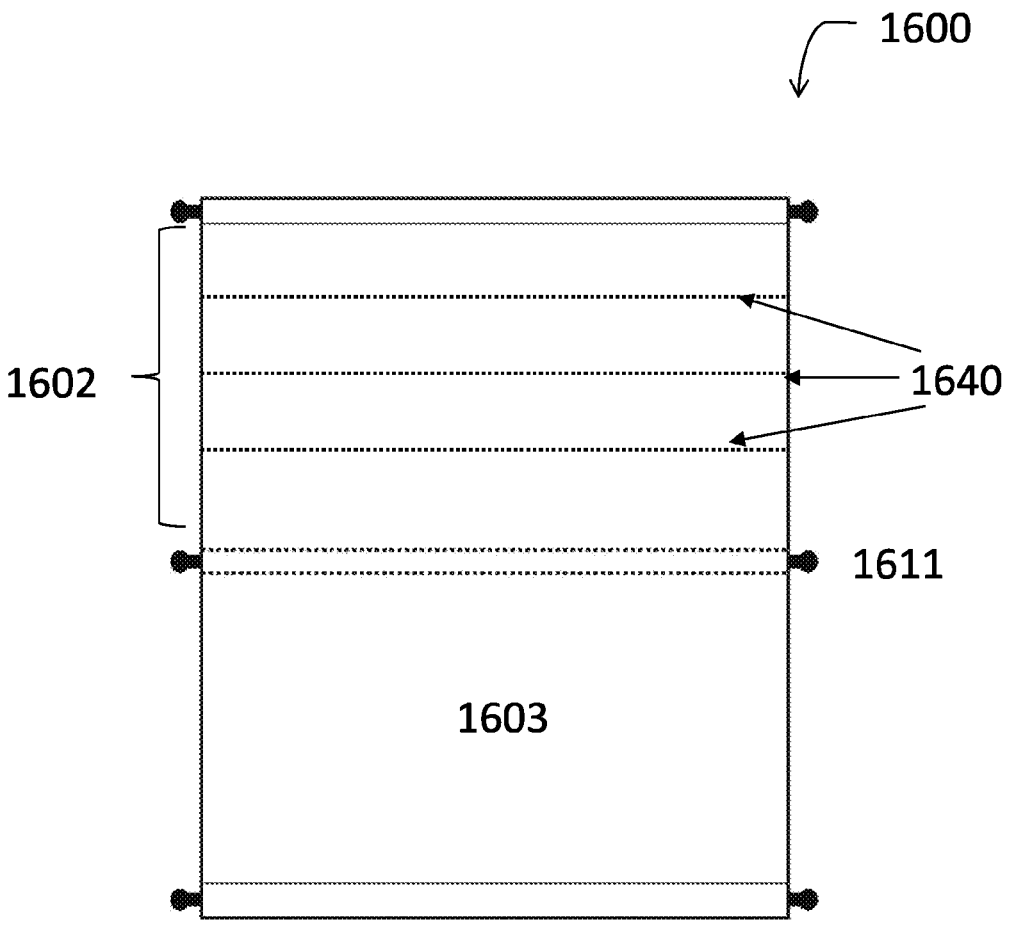
FIG. 16 illustrates an exemplary adjustable window covering system comprising a material layer with creases or folds incorporated into at least one of the panels.

FIG. 16 illustrates an exemplary adjustable window covering system comprising a material layer wherein at least one of the panels is rigid. Adjustable window covering system 1600 can comprise an upper panel 1602 and a lower panel 1603. The material layer of at least one of the upper panel and the lower panel can be rigid. The rigid material layer can include creases or folds 1640 that can allow the user to dynamically change the amount of coverage or the configuration of the window covering system, as discussed above. In some examples, at least one of the upper panel and the lower panel can be a single piece of rigid material without any creases or folds. In some examples, the adjustable window covering system can include a crease or fold at the location at or near the middle rod 1611. In some examples, the upper panel 1602 of the material layer can be rigid, and the lower panel 1603 of the material layer can be flexible. In some examples, the material layer can be flexible and can include creases or folds.

In some examples, the adjustable window covering system can be mounted to be protruding from the window. Extending members can be mounted on the inside or outside of the window and can extend outward from the window. The one or more rods can be positioned such that the tension of the spring in each rod is transferred to the one or more extending members. In some examples, the shape and size of the extending members can be configured to account for the transfer of tension from the spring of the plurality of rods to the extending members. In some examples, the adjustable window covering system can be mounted in different orientations such as vertically. In some examples, the adjustable window covering system can be used as a storage bin. One or more panels of the material layer can be folded or overlapped to create a pocket to hold or conceal items. In some examples, a rod can be coupled to more than one opening.

The capability of the adjustable window covering system to be dynamically adjusted can allow the user to easily remove the adjustable window covering system. Installation of the adjustable window covering system can be done without the use of tools and without damage done to the walls of the window. The adjustable window covering system can be easily reconfigured and the rods can be repositioned to cover a different end of the window or to change the amount of coverage of the window. Additionally different panels of the material layer can be visible to the user or different styles or variations can be incorporated. In some examples, the adjustable window covering system can be relocated to cover a different window. The material layer of the adjustable window covering system can also be removed or replaced for improved aesthetic appeal or to be laundered for improved sanitation. While one or more examples of the disclosure are directed to covering a window, the adjustable window covering system can be used to cover any opening or surface.

Figure 17A:
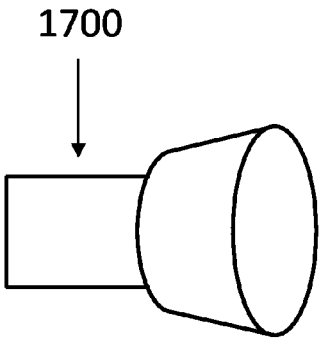
FIGS. 17A-17D illustrate exemplary footpad and rod designs.
Figure 17B:
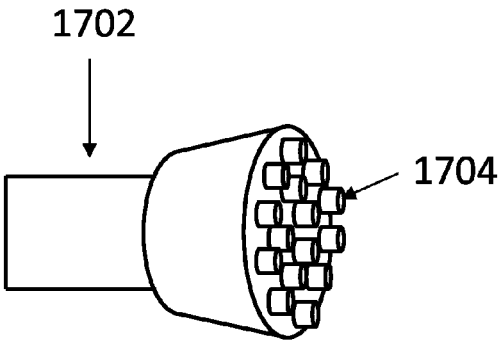

As discussed above, at least one of the first and second ends can be covered with footpads for cushioning and protecting the window jambs, or to improve its grip on the window jambs. FIGS. 17A-17D illustrate some example footpads according to examples of the disclosure. FIG. 17A illustrates a footpad 1700 formed from a compressible material such as rubber. FIG. 17B illustrates a footpad 1702 having multiple protruding members 1704 formed from a compressible material such as rubber. In some examples, the footpads can be different shapes such as circular or rectangular.

Figure 17C:
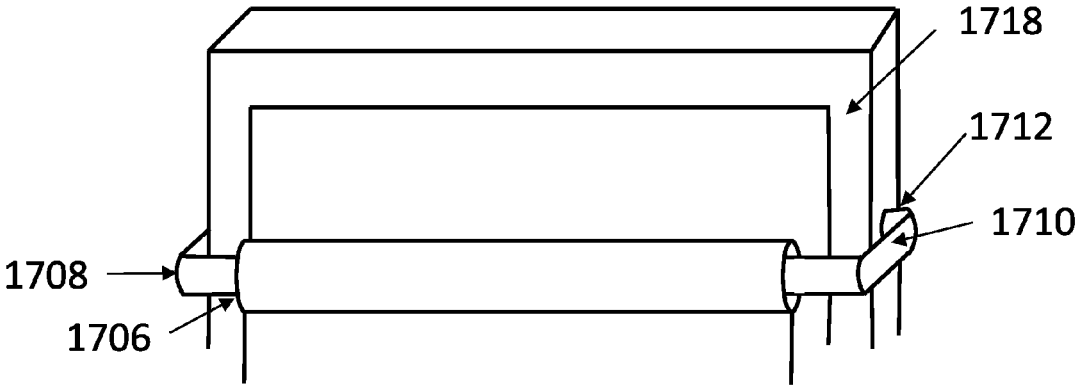

FIG. 17C illustrates an alternative rod design 1706 with first and second ends 1708 and 1710 and footpads 1712 designed to clamp onto the outside of a window casing 1718. In such examples, the rods can be alternatively designed to apply force inwardly, wherein the release mechanisms such as levers and buttons can serve to release the clamping forces of the rods. The alternative footpad of FIG. 17C can be employed when the interior jamb surfaces of the window opening are blocked by objects such as blinds, plantation shutters, and the like. The material layer can still be adjusted as described above by clamping the rods at different locations on the window casing.

Figure 17D:
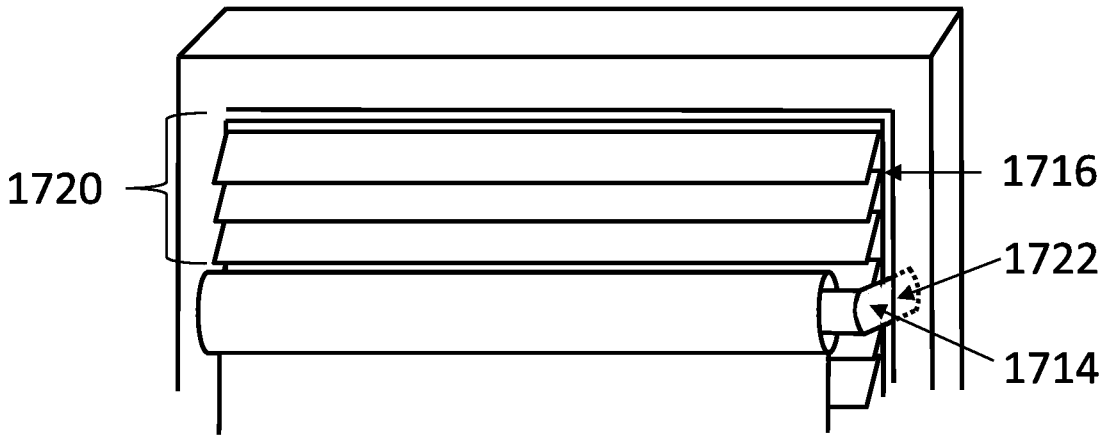

FIG. 17D illustrates an alternative footpad 1714 designed to slip into a narrow space 1716 near the interior jamb surfaces of the window opening when those surfaces are blocked by objects such as blinds, plantation shutters 1720, and the like. In the example of FIG. 17D, the footpad 1714 can include a plate 1722, which can apply force to the window jamb to hold the rod and window covering in place. The material layer can still be adjusted as described above by relocating the rods at different locations on the window jamb.

Examples of the disclosure can be advantageous in allowing a user to dynamically adjust the location, position, and configuration of an adjustable window covering system. The installation and adjustment can be executed without the use of tools and without damage done to the walls of a window.

Some examples of the disclosure are directed to an apparatus for covering an opening, comprising: a material layer having first and second distal ends; and a plurality of rods held by the material layer, at least one of the plurality of rods held between the first and second distal ends; wherein the plurality of rods are configured to be dynamically adjustable with respect to each other and removably attachable to a structure of the opening to create different arrangements of the material layer. Additionally or alternatively to one or more of the examples described above, the material layer comprises one or more openings configured for holding the plurality of rods. Additionally or alternatively to one or more of the examples described above, at least a portion of the material layer is flexible. Additionally or alternatively to one or more of the examples described above, at least a portion of the material layer is rigid and includes one or more creases configured to be brought into a stacked arrangement. Additionally or alternatively to one or more of the examples described above, the material layer comprises a plurality of panels. Additionally or alternatively to one or more of the examples described above, at least one of the panels of the material layer is substantially or partially transparent. Additionally or alternatively to one or more of the examples described above, the apparatus further comprises an adhesive layer disposed on at least one side of the material layer, wherein the adhesive layer is configured for the formation of the one or more openings. Additionally or alternatively to one or more of the examples described above, the apparatus further comprises a backing layer disposed on at least one side of the material layer, the backing layer including one or more patterns. Additionally or alternatively to one or more of the examples described above, the plurality of rods includes at least one of a lever, a pole, a spring, a link, one or more gears, a post, and one or more buttons. Additionally or alternatively to one or more of the examples described above, the plurality of rods comprises one or more locking mechanisms. Additionally or alternatively to one or more of the examples described above, the apparatus further comprises one or more plates coupled to one or more ends of the rod, wherein the plates are configured for applying force to the structure. Additionally or alternatively to one or more of the examples described above, the apparatus further comprises a second material layer, wherein the second material layer is coupled to one or more of the plurality of rods. Additionally or alternatively to one or more of the examples described above, the one or more of the plurality of rods are coupled to one or more footpads. Additionally or alternatively to one or more of the examples described above, the one or more of the footpads include a plurality of protruding members.

Some examples of the disclosure are directed to a method for covering an opening comprising: forming a plurality of connection points in a material layer; holding a plurality of rods at the connection points, wherein at least one of the plurality of rods is held between first and second distal ends of the material layer; and positioning the plurality of rods within the opening to cover at least a portion of the opening with the material layer. Additionally or alternatively to one or more of the examples described above, the method further comprises positioning a first rod between a top and bottom of the opening. Additionally or alternatively to one or more of the examples described above, the method further comprises dynamically positioning a second rod above the first rod to adjust the covering of the opening with the material layer. Additionally or alternatively to one or more of the examples described above, the method further comprises dynamically positioning a second rod below the first rod to adjust the covering of the opening with the material layer.

Some examples of the disclosure are directed to a method for covering an opening, comprising: supporting a material layer at a first location between opposite edges of the material layer and at one or more second locations along the material layer; supporting the first location of the material layer at a primary position between a top and bottom of the opening and supporting the one or more second locations at one or more secondary positions within the opening; and repositioning the one or more secondary positions with respect to the primary position to change the covering of the opening.

Some examples of the disclosure are directed to an apparatus for covering an opening, comprising: a first rod supporting a material layer at a first location between opposite edges of the material layer; and one or more second rods supporting the material layer at one or more second locations along the material layer, wherein the first rod is configured for being held at a primary position between a top and bottom of the opening and the one or more second rods are configured for being held at one or more secondary positions within the opening; and wherein the one or more second rods are configured for being dynamically repositionable with respect to the first rod within the opening to change the covering of the opening.

Although examples of the disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

What is claimed is:

1. An apparatus for covering an opening, comprising:

a material layer having first and second distal ends; and three or more rods held by the material layer, at least one of the three or more rods held by the material layer between the first and second distal ends, wherein each rod is dynamically adjustable with respect to the other rods and removably attachable, without a screw, nail, or adhesive, to any location along a length of a structure forming the opening to create different arrangements of the material layer, a length of each rod adjusted by lifting or pressing a lever or button located on and protruding externally from the rod, wherein each rod applies a force to removably attach to the structure, the different arrangements consisting of fully covering the opening and partially covering the opening, wherein partially covering the opening includes one or more folds between at least one pair of adjacent rods.

2. The apparatus of claim 1, wherein each rod is configured to clamp to outer edges of the structure.

3. The apparatus of claim 1, wherein at least a portion of the material layer is flexible.

4. The apparatus of claim 1, wherein at least a portion of the material layer is rigid and includes one or more creases configured to be brought into a stacked arrangement.

5. The apparatus of claim 1, wherein the material layer comprises a plurality of panels, wherein adjacent panels are separated by an opening in the material layer.

6. The apparatus of claim 5, wherein at least one of the panels of the material layer is substantially or partially transparent.

7. The apparatus of claim 2, wherein the material layer comprises one or more openings configured for holding the three or more rods, further comprising:

an adhesive layer disposed on at least one side of the material layer, wherein the adhesive layer is configured for formation of the one or more openings.

8. The apparatus of claim 1, further comprising:

a removable backing layer disposed on at least one side of the material layer, the removable backing layer including one or more patterns.

9. The apparatus of claim 1, wherein each rod includes a plurality of poles, a spring and a link coupled to the lever or button and the spring, the link including a first position to allow compression of the spring and a second position to prevent compression of the spring.

10. The apparatus of claim 1, wherein each rod comprises one or more locking mechanisms configured to lock the lever or button when the rod is attached to the structure.

11. The apparatus of claim 1, further comprising:

one or more plates coupled to one or more ends of the rod, wherein the plates are configured for transferring force to the structure.

12. The apparatus of claim 1, further comprising:

a second material layer separate and distinct from the material layer, wherein the second material layer is coupled to one or more of the three or more rods.

13. The apparatus of claim 1, wherein one or more of the three or more rods are coupled to one or more footpads and the one or more footpads includes a plurality of protruding members.

14. The apparatus of claim 1, wherein each rod is removably attached and contacts the structure.

15. A method for covering an opening, the method comprising:

forming a plurality of connection points in a material layer;

holding three or more rods at the connection points, wherein at least one of the three or more rods is held between first and second distal ends of the material layer, the plurality of rods held by the material layer without a nail, screw, or adhesive to a structure forming the opening;

adjusting a length of each rod by lifting or pressing a lever or button located on and protruding externally from the rod;

removably attaching each rod to the structure; and dynamically positioning each rod to any location along a length of the structure to either fully cover the opening or partially cover the opening, wherein partially covering the opening includes one or more folds between at least one pair of adjacent rods.

16. The method of claim 15, further comprising positioning each rod at locations separate and distinct from a top and a bottom of the opening.

17. The method of claim 16, wherein all of the three or more rods are attached at locations below a middle of the opening.

18. The method of claim 15, wherein the three or more rods includes a first rod located at the first distal end, a second rod located at the second distal end, and a third rod located between the first and second distal ends, and further wherein the first, second, and third rods are attached to the structure such that a distance between the first and second rods is less than a distance between the second and third rods.

19. A method for covering an opening, comprising:

supporting a material layer at a first location between opposite edges of the material layer and at one or more second locations along the material layer;

supporting the first location of the material layer at a primary position between a top and bottom of the opening and supporting the one or more second locations at one or more secondary positions within the opening, wherein the supported first and second locations of the material layer are held by two or more rods removably attached without a nail, screw, or adhesive to a structure forming the opening wherein removably attaching each rod includes adjusting a length of each rod by lifting or pressing a lever or button located on and protruding externally from the rod to apply a force to the structure; and dynamically repositioning the one or more secondary positions with respect to the primary position to any location along a length of the structure to change the covering of the opening, wherein changing the covering consists of fully covering the opening and partially covering the opening with one or more folds between at least one pair of adjacent rods.

20. An apparatus for covering an opening, comprising:

a first rod supporting a material layer at a first location between opposite edges of the material layer, wherein ends of the first rod are removably attached and in contact with a structure forming the opening; and three or more second rods supporting the material layer at one or more second locations along the material layer, wherein ends of each of the three or more second rods are removably attached and in contact with the structure, wherein the first rod configured for being held without a screw, nail, or adhesive to the structure at a primary position between a top and bottom of the opening and the three or more second rods are configured for being held without a screw, nail, or adhesive to the structure of the opening at three or more secondary positions within the opening, further wherein a length of each of the three or more second rods is adjusted by lifting or pressing a lever or button located on and protruding externally from each rod and further wherein the apparatus consists of a first arrangement of fully covering the opening and a second arrangement of partially covering the opening with one or more folds between at least one pair of adjacent rods.

* * * * *